US012000276B2

(12) United States Patent
Alshakhs et al.

(10) Patent No.: US 12,000,276 B2
(45) Date of Patent: Jun. 4, 2024

(54) SYSTEM FOR AUTOMATED REAL-TIME WATER INJECTION WELL TESTING

(71) Applicant: SAUDI ARABIAN OIL COMPANY, Dhahran (SA)

(72) Inventors: Mohammed J. Alshakhs, Arawabi (SA); Said Rifat, Medina (SA); Abiola Onikoyi, Khurais (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 274 days.

(21) Appl. No.: 17/648,075

(22) Filed: Jan. 14, 2022

(65) Prior Publication Data

US 2023/0228188 A1 Jul. 20, 2023

(51) Int. Cl.

| | |
|---|---|
| ***E21B 49/00*** | (2006.01) |
| ***E21B 49/08*** | (2006.01) |
| *E21B 47/06* | (2012.01) |

(52) U.S. Cl.
CPC ..... *E21B 49/008* (2013.01); *E21B 49/087* (2013.01); *E21B 47/06* (2013.01)

(58) Field of Classification Search
CPC ..... E21B 47/06; E21B 49/008; E21B 49/087
See application file for complete search history.

(56) References Cited

U.S. PATENT DOCUMENTS

| | | | | |
|---|---|---|---|---|
| 3,709,032 | A | 1/1973 | Coles, Jr. et al. | |
| 5,458,192 | A | 10/1995 | Hunt | |
| 8,078,328 | B2 | 12/2011 | Malki et al. | |
| 10,459,118 | B2 * | 10/2019 | Al-Ajmi | G01V 99/005 |
| 10,900,344 | B2 * | 1/2021 | Al-Hajri | E21B 47/00 |
| 11,414,979 | B2 * | 8/2022 | Santarelli | E21B 43/20 |
| 11,733,423 | B2 * | 8/2023 | Alhuraifi | G01V 99/005 703/10 |
| 2009/0276100 | A1 * | 11/2009 | Malki | E21B 49/008 700/282 |
| 2016/0319655 | A1 * | 11/2016 | Awadh | G05B 19/402 |
| 2018/0003858 | A1 * | 1/2018 | Al-Ajmi | E21B 47/09 |
| 2020/0370412 | A1 * | 11/2020 | Santarelli | E21B 43/40 |

(Continued)

FOREIGN PATENT DOCUMENTS

| | | | |
|---|---|---|---|
| WO | 2017192423 | A1 | 11/2017 |
| WO | 2021072108 | A1 | 4/2021 |

OTHER PUBLICATIONS

P.M. Jarrell et al. "Maximizing Injection Rates in Wells Recently Converted to Injection Using Hearn and Hall Plots" SPE 21724; Apr. 1991 (8 pages).

(Continued)

*Primary Examiner* — John Fitzgerald
(74) *Attorney, Agent, or Firm* — Osha Bergman Watanabe & Burton LLP

(57) ABSTRACT

A method includes installing a measurement device on the injection wellhead, injecting a fluid into the injection well at a plurality of injection rates using a computer processor, measuring an injection bottom hole pressure at each injection rate to determine a plurality of injection bottom hole pressures using the computer processor, determining a relationship between the plurality of injection rates and the plurality of injection bottom hole pressures using the computer processor, and determining an injectivity index of the injection well using the relationship and the computer processor.

20 Claims, 5 Drawing Sheets

(56) References Cited

U.S. PATENT DOCUMENTS

| | | | | |
|---|---|---|---|---|
| 2021/0109251 | A1* | 4/2021 | Alhuraifi | E21B 47/117 |
| 2021/0148227 | A1* | 5/2021 | Santarelli | E21B 49/008 |

OTHER PUBLICATIONS

A. Hassan et al. "New approach to evaluate the performance of highly deviated water injection wells using artificial neural network" Journal of Petroleum Science and Engineering 196; Aug. 2020 (8 pages).

ScienceDirect "Injectivity Index" 2021 <URL: https://www.sciencedirect.com/topics/engineering/injectivity-index> (36 pages).

* cited by examiner

SYSTEM FOR AUTOMATED REAL-TIME WATER INJECTION WELL TESTING

BACKGROUND

In the oil and gas industry, hydrocarbons are located in porous formations far beneath the Earth's surface. Wells are drilled into these formations, also called reservoirs, to produce the hydrocarbons. As a well produces hydrocarbons from the reservoir, the reservoir pressure may decrease which may hinder future recovery of the hydrocarbons. As such, injection wells are often drilled into the reservoir. Injection wells inject a fluid into the reservoir to increase the depleted reservoir pressure. A mathematical indicator of the performance of an injection well is the injectivity index. The injectivity index is the rate of fluid injection over the pressure differential. The injectivity index is not only an indication of the injection well's performance but also an indication of various reservoir properties such as permeability, pay zone thickness, etc.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for determining an injectivity index of an injection well having an injection wellhead. The method includes installing a measurement device on the injection wellhead, injecting a fluid into the injection well at a plurality of injection rates using a computer processor, measuring an injection bottom hole pressure at each injection rate to determine a plurality of injection bottom hole pressures using the computer processor, determining a relationship between the plurality of injection rates and the plurality of injection bottom hole pressures using the computer processor, and determining an injectivity index of the injection well using the relationship and the computer processor.

The system includes a measurement device installed on the injection wellhead and a non-transitory computer readable medium coupled to the measurement device. The non-transitory computer readable medium stores instructions comprising functionality for injecting a fluid into the injection well at a plurality of injection rates, measuring an injection bottom hole pressure at each injection rate to determine a plurality of injection bottom hole pressures, determining a relationship between the plurality of injection rates and the plurality of injection bottom hole pressures, and determining an injectivity index of the injection well using the relationship.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
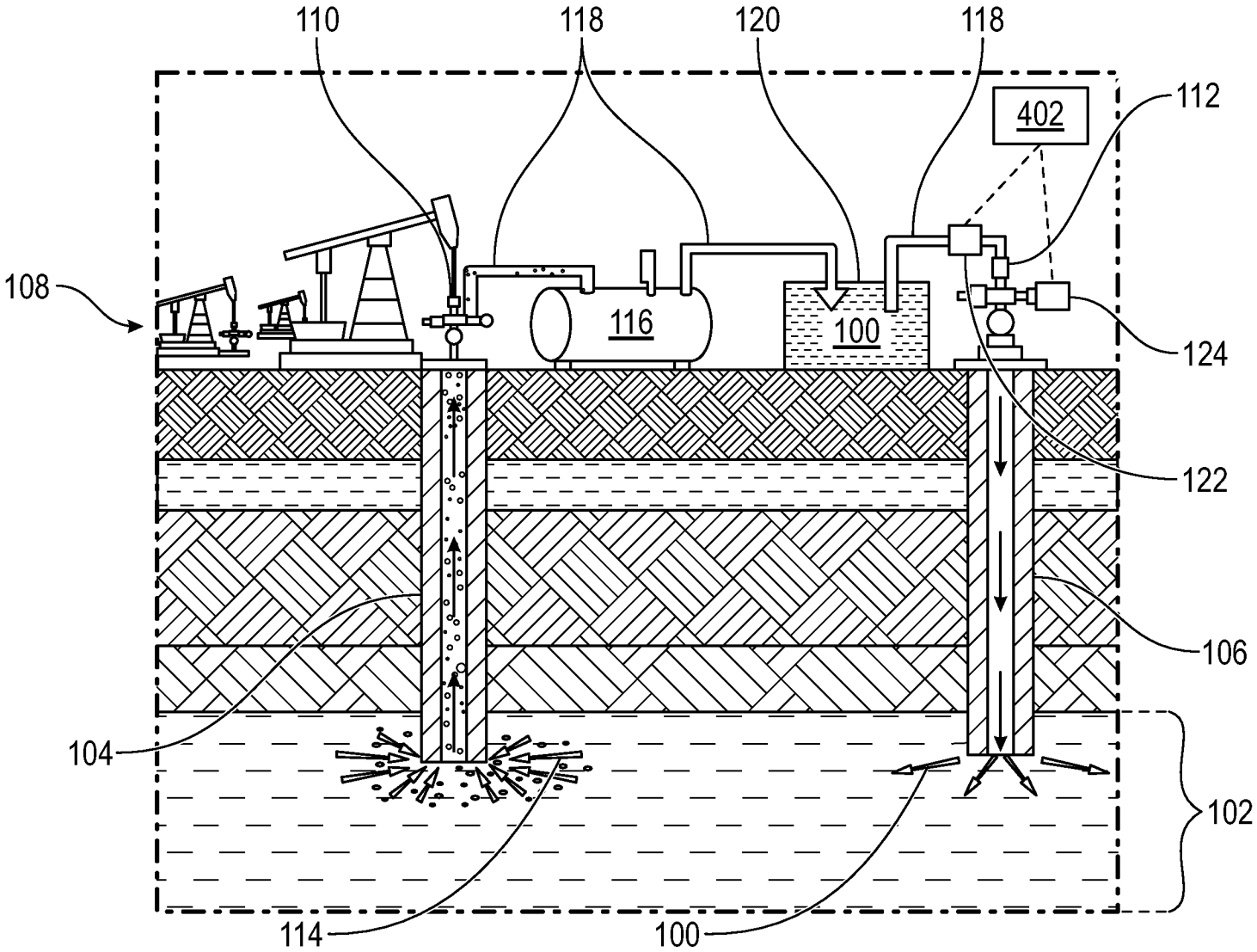
FIG. 1 shows an exemplary well site in accordance with one or more embodiments.

FIG. 1 shows an exemplary well site in accordance with one or more embodiments. The particular system shown in FIG. 1 is for illustration purposes only; the scope of this disclosure is intended to encompass any type of well that may inject a fluid, such as water (100), into a formation (102). Specifically, FIG. 1 shows a secondary recovery system with a production well (104) and an injection well (106) extending from a surface location (108) into a formation (102).

The surface location (108) may be any location on or above the surface of the Earth. The production well (104) may be capped at the surface location (108) by a production wellhead (110). The injection well (106) may be capped at the surface location (108) by an injection wellhead (112). The formation (102) may be a hydrocarbon formation (102) in accordance with one or more embodiments. Produced fluids (114) may be produced by the production well (104).

In accordance with one or more embodiments, the produced fluids (114) may be a mixture of hydrocarbons and water (100). The produced fluids (114) may flow from the formation (102) to the surface location (108) using the production well (104). The produced fluids (114) may exit the production well (104) through the production wellhead (110). The production wellhead (110) may be connected to a separator (116) by any means known in the art, such as a pipeline (118). The separator (116) may receive the production fluids (114) and separate the water (100) from the hydrocarbons.

The water (100) may be pumped back into the formation (102) using the injection well (106). Specifically, a pump (not pictured) may pump the water (100) from the separator (116) to the storage tank (120) using any means in the art such as a pipeline (118). In other embodiments, the separator (116) and the storage tank (120) may be one and the same. Another pump (not pictured) may pump the water (100) from the storage tank (120) to the injection wellhead (112) using the pipeline (118). The water (100) may be pumped, using the same pump or a different pump, into the injection well (106) and subsequently into the formation (102).

One or more measurement devices may be connected to the injection wellhead (112) to measure various injection parameters. In accordance with one or more embodiments, a flow rate measurement device (122) and a pressure measurement device (124) may be connected to the injection wellhead (112). The flow rate measurement device (122) and the pressure measurement device (124) may be directly or indirectly connected to the injection wellhead (112).

For example, the flow rate measurement device (122) may be connected to the outlet of the pump pumping the water (100) into the injection well (106) and the pressure measurement device (124) may be connected to one of the wing valves on the injection wellhead (112). The flow rate measurement device (122) may be any type of flow meter known in the art such as an ultrasonic meter, a vortex meter, a turbine meter, etc. The pressure measurement device (124) may be any type of pressure gauge known in the art such as an elastic pressure transducer, a bourdon tube pressure gauge, a diaphragm pressure gauge, etc.

The pressure measurement device (124), the flow rate measurement device (122), and the injection wellhead (112) may be connected, wirelessly or wired, to a computer (402). The computer (402) may include a computer processor (405) that is able to interact with the injection wellhead (112), the pressure measurement device (124), and the flow rate measurement device (122) to collect data, send instructions, perform calculations, etc. The computer (402) is further described in FIG. 4.

It is important to be able to track and measure the performance of the injection well (106) in order to mitigate future injection problems and/or plan stimulation operations to improve the efficiency of the injection operation. An injectivity index is a mathematical indicator of the performance of the injection well (106). Current methods used to determine the injectivity index of an injection well (106) include conducting a fall-off test. A fall-off test requires maintaining injection rates of the injection well (106) for a short period of time followed by an extended shut-in period. The injection rates and the pressure decline (also called the transient pressure) are recorded and manually analyzed to determine the injectivity index.

As can be inferred from above, the fall off-test requires the injection well (106) to be shut in for a period time which effects the productivity of the injection well (106). Further, calculating the injectivity index using the fall-off test cannot be performed during normal operations and in real-time. Thus, the ability to determine the injectivity index without shutting in the injection well (106) is beneficial. As such, embodiments presented herein outline systems and methods that use injection rates and injection bottom hole pressures to determine the injectivity index while the injection well (106) is under injection.

Changes in the injection rate and the associated changes in the injection bottom hole pressure may be used to calculate the injectivity index as shown in Equation (1) below:

$$q=II\times P_f-II\times P_s \qquad \text{Equation (1)}$$

Where q is the injection flow rate, II is the injectivity index, $P_f$ is the injection bottom hole pressure, $P_s$ is the shut-in bottom hole pressure. When the fluid in the injection well (106) is a fluid having a known pressure gradient, or density, the injection bottom hole pressure ($P_f$) may be determined using Equation (2) below:

$$P_f=\text{gradient}*\text{depth}+P_{f\text{-}}+P_m \qquad \text{Equation (2)}$$

Where gradient is the pressure gradient, or density, of the fluid in the injection well (106), the depth is the depth of the injection well (106), $P_{f\text{-}}$ is the pressure loss due to friction, and $P_m$ is the pressure of the injection well (106) measured at the surface location (108) using the pressure measurement device (124). The pressure loss due to friction may be calculated based off of the injection rate.

The changes in the shut-in bottom hole pressure and reservoir pressure are assumed to be negligible if the injectivity index is evaluated over a short time period. As such, Equation (1) becomes an equation of a straight line as shown in Equation (3) below:

$$y=II\times x-C \qquad \text{Equation (3)}$$

Where y and x represent q and $P_f$, respectively. Thus, the injectivity index may be obtained by determining the equation of the line crated by plotting the injection rate versus the injection bottom hole pressure. This method is outlined further in FIG. 2.

Figure 2:
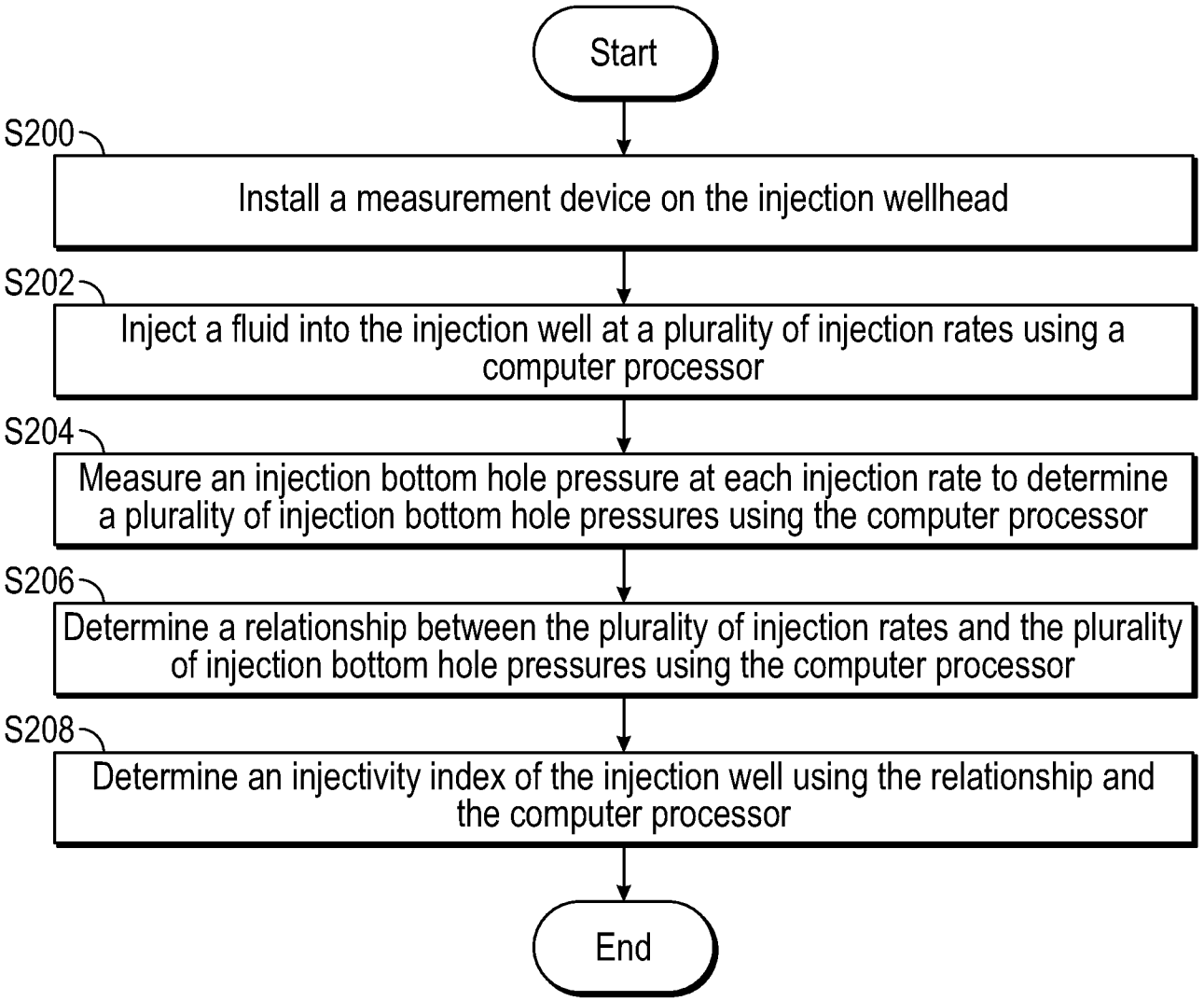
FIG. 2 shows a flowchart in accordance with one or more embodiments.

FIG. 2 shows a flowchart in accordance with one or more embodiments. The flowchart outlines a method for determining the injectivity index of an injection well (106) using the injection rates and the injection bottom hole pressures of the injection well (106). While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a measurement device is installed on the injection wellhead (112) (S200).

In accordance with one or more embodiments, the measurement device may be the flow rate measurement device (122) and/or the pressure measurement device (124) described above in FIG. 1. A fluid is injected into the injection well (106) at a plurality of injection rates using a computer processor (405) (S202). The fluid may be water (100), and the water (100) may be formation water (100) separated from production fluids (114). The fluid may be pumped from a storage tank (120) into the injection well (106) using a pipeline (118).

The flow rate of the injection fluid, i.e., the injection rate, may be controlled by the computer processor (405), and the actual injection flow rate seen at the injection wellhead (112) may be determined by the flow rate measurement device (122). Herein, the term "injection rate(s)" may refer to either the injection rates instructed by the computer processor (405), or the actual injection rates measured by the flow rate measurement device (122) at the injection wellhead (112).

An injection bottom hole pressure is measured at each injection rate to determine a plurality of injection bottom hole pressures using the computer processor (405) (S204). A relationship is determined between the plurality of injection rates and the plurality of injection bottom hole pressures using the computer processor (405) (S206). The relationship between the plurality of injection rates and the plurality of injection bottom hole pressures may be determined by plotting the injection rates vs. the injection bottom hole pressures on a graph and fitting a line through the data points.

An injectivity index of the injection well (106) is determined using the relationship and the computer processor (405) (S208). In accordance with one or more embodiments, the relationship may be an equation of a straight line having a slope as shown in FIG. 3*b*. The slope of the straight line may be equated to the injectivity index. The data points used in determination of the injectivity index may be the normal injection rates and associated injection bottom hole pressures seen while the injection well (106) is undergoing normal operations. Or the injection rates may undergo variable rate injection for at least four rates. The injection rates may change anywhere form one to thirty percent of a normal injection rate. Further, the rate change duration should be at least one hour long.

For example, the injection rates may be changed from 130% of the normal injection rate to 70% of the normal injection rate, decreasing at an interval of 10%. That is, the injection rate may be adjusted by the following sequence: 130%, 120%, 110%, 100%, 90%, 80%, and 70%. The associated injection bottomhole pressure may be measured at each injection rate using the pressure measurement device (124).

The injection rates may be changed, and the injection bottom hole pressures may be measured, at a set frequency. In accordance with one or more embodiments, the frequency may be once a day. Further, the data may be measured and plotted for a set cycle of time. Further, the injectivity index of the injection well may be determined over a plurality of cycles of time where each cycle uses the same set frequency to change the injection rate and measure the injection bottom hole pressure.

In accordance with one or more embodiments, the rate change may be the sequence listed above, the cycle may be seven days, and the frequency may be once per day. The maximum rate changes of +/−30% may be reduced if the changes are found to cause drastic changes in reservoir pressure or yield low quality results for the calculated injectivity index.

Low quality results may be qualified by the correlation coefficient of the relationship. For example, the injectivity index may only be used if the correlation coefficient is greater than a set limit, such as 0.75. Further, low quality results may be qualified by injectivity indexes that are anomalous compared to the other injectivity indexes for the same injection well (106). For example, injectivity indexes that are less than 0 bbl/day/psig (barrels per day per pounds per square inch gauge) or greater than 150 bbl/day/psig may be excluded.

Figure 3A:
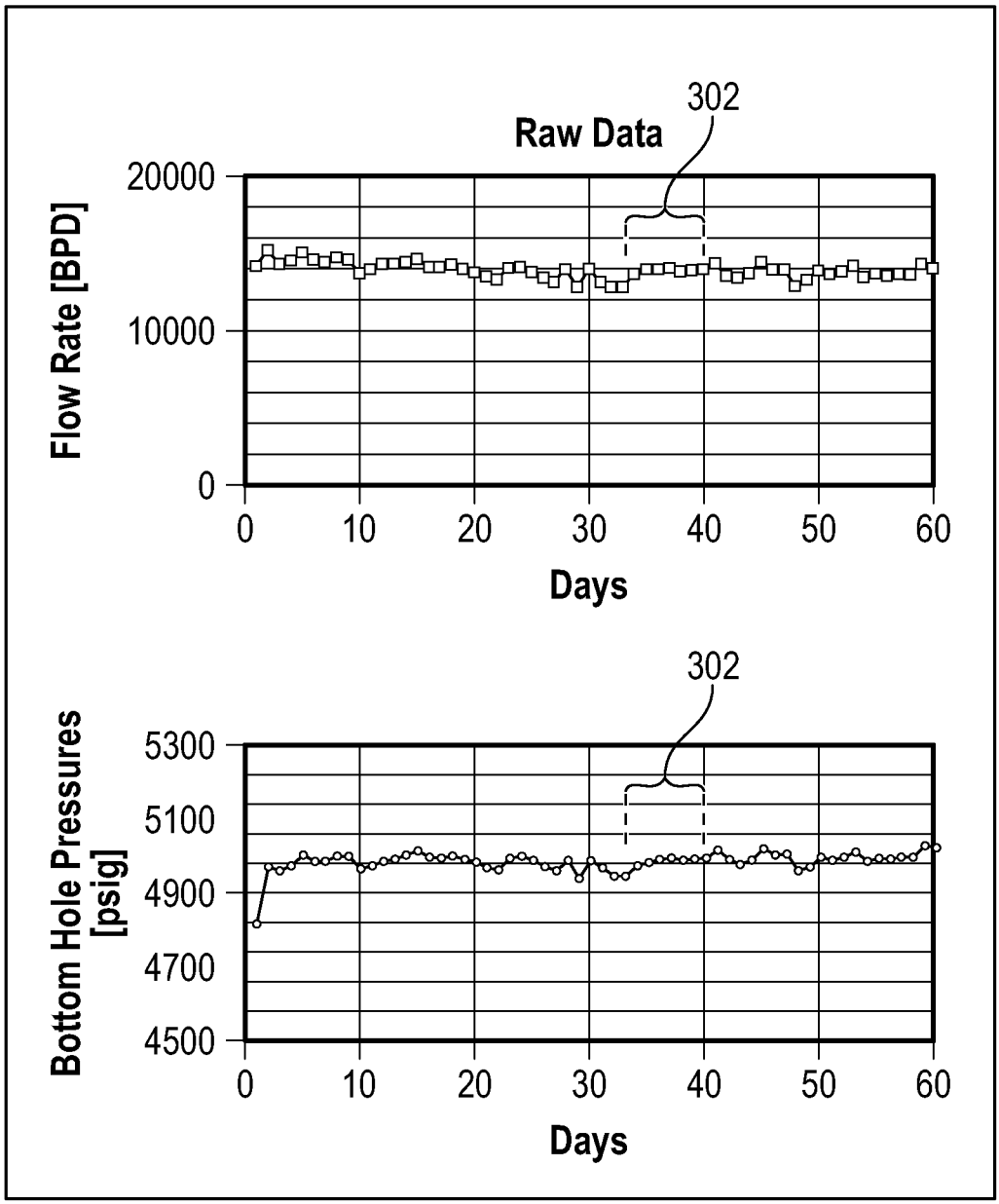
FIGS. 3*a*-3*c* show injectivity index determination graphs in accordance with one or more embodiments.
Figure 3B:
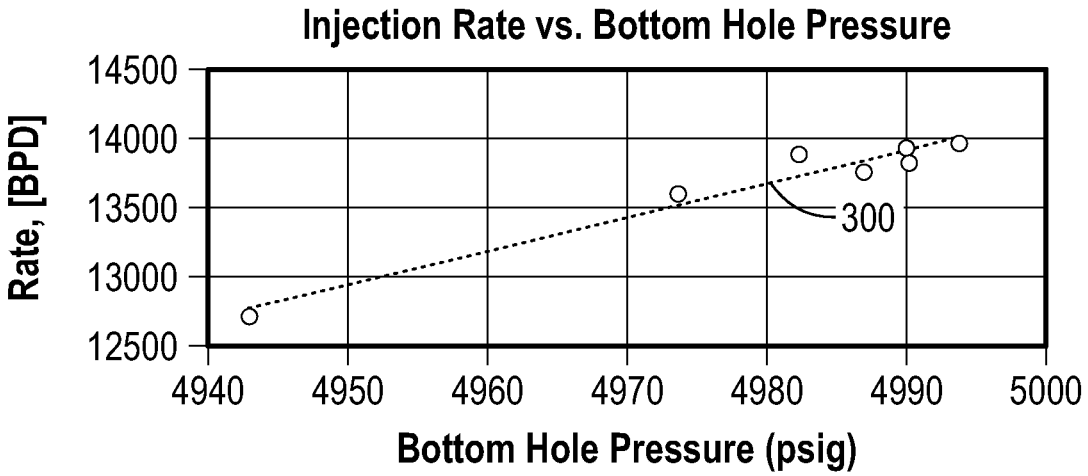
Figure 3C:
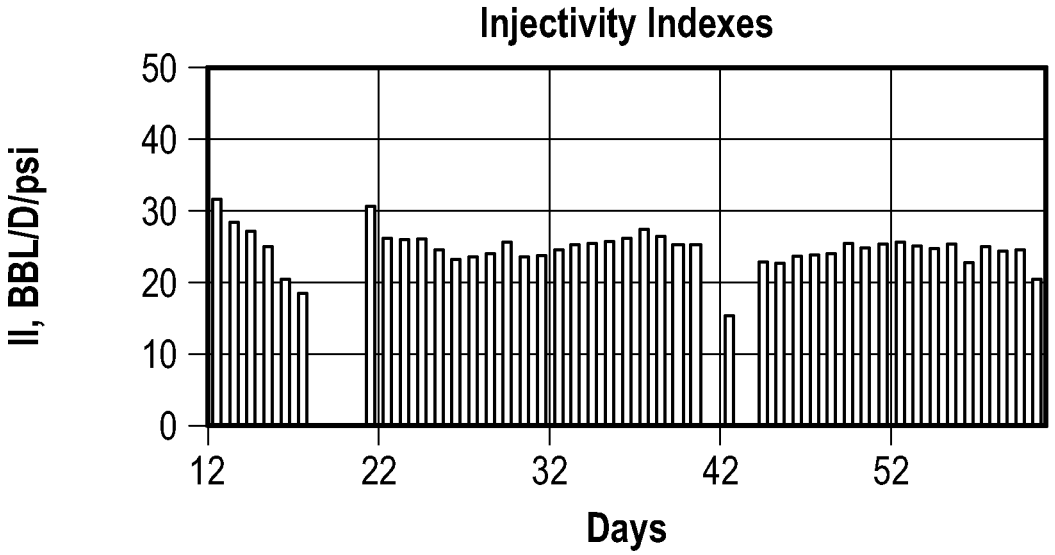

FIGS. 3*a*-3*c* show an example of determining the injectivity index for an injection well (106) over a cycle (302) of time. Specifically, FIG. 3*a* shows the injection flow rates and associated injection bottom hole pressures measured at a daily frequency over a period of 60 days. The injection flow rates and associated injection bottom hole pressures for a cycle (302) of time occurring during the 60-day time period are plotted in FIG. 3*b*. A line is fit to the data points. This line is the relationship (300) between the injection flow rates and associated injection bottom hole pressures. Equation (4), below, may be the equation of the line shown in FIG. 3*b*.

$$y=24.173x-106712 \qquad \text{Equation (4)}$$

Where x=bottom hole pressure in psig and y=flow rate in BPD. As can be seen by Equation (4), 24.173 is the slope of the line, thus the injectivity index for this data is equal to 24.173 bbl/D/psig. FIG. 3*c* shows a plurality of injectivity indexes for an injection well (106) over time. In one or more embodiments, the injectivity indexes shown in FIG. 3*c* may have been measured each day using the data gathered during the prior seven days. The seven days being the cycle (302) and the daily measurement being the frequency at which the data is measured. This data may be used to monitor the injectivity index over the life of the injection well (106). This process may be automated using the computer (402) system further outlined in FIG. 4.

Figure 4:
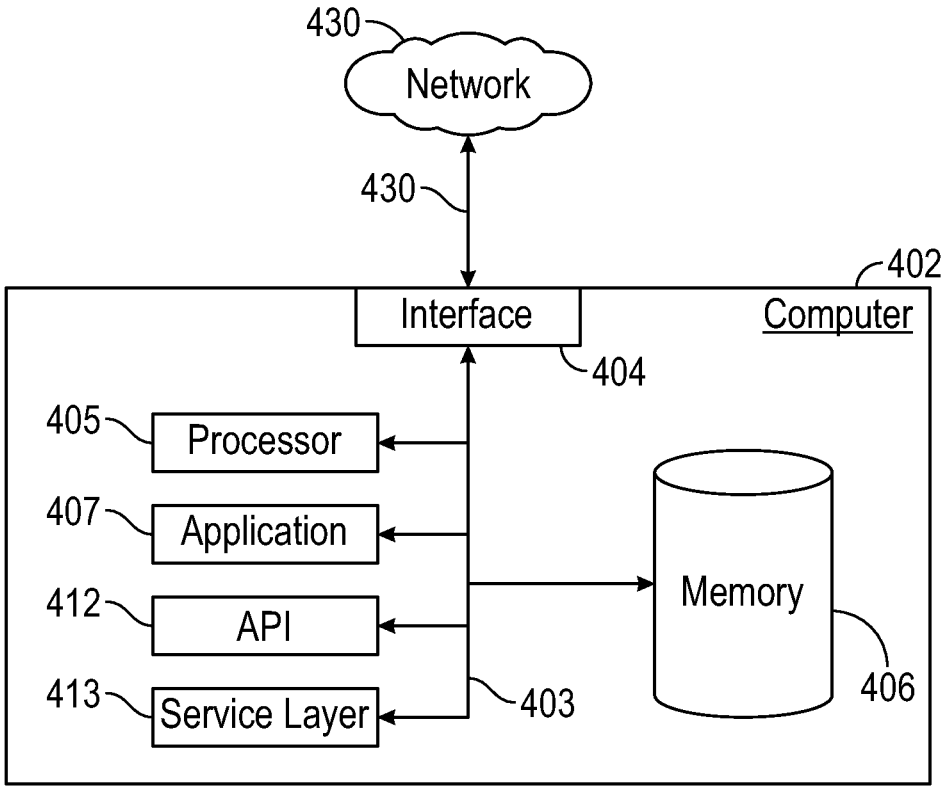
FIG. 4 shows a computer system in accordance with one or more embodiments.

FIG. 4 shows a computer (402) system in accordance with one or more embodiments. Specifically, FIG. 4 shows a block diagram of a computer (402) system used to provide computational functionalities associated with described algorithms, methods, functions, processes, flows, and procedures as described in the instant disclosure, according to an implementation. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402).

The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a non-transitory computer (402) readable medium, or a memory (406), that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for an injection well having an injection wellhead, the method comprising:

installing a measurement device on the injection wellhead, wherein the measurement device is configured to measure a pressure of the injection well at the injection wellhead;

injecting a fluid into the injection well at a plurality of injection rates using a computer processor;

measuring an injection bottom hole pressure at each injection rate to determine a plurality of injection bottom hole pressures using the computer processor, wherein the injection bottom hole pressure at each injection rate is measured using a density of a fluid in the injection well, a depth of the injection well, a pressure loss due to friction, and the pressure of the injection well at the injection wellhead at each injection rate;

determining a relationship between the plurality of injection rates and the plurality of injection bottom hole pressures using the computer processor; and determining an injectivity index of the injection well using the relationship and the computer processor.

2. The method of claim 1, wherein installing the measurement device on the injection wellhead further comprises installing a flow rate measurement device and a pressure measurement device to the injection wellhead.

3. The method of claim 1, wherein injecting the fluid into the injection well at the plurality of injection rates further comprises pumping the fluid from a storage tank into the injection well using a pipeline.

4. The method of claim 1, wherein determining the relationship between the plurality of injection rates and the plurality of injection bottom hole pressures further comprises determining an equation of a straight line having a slope.

5. The method of claim 4, wherein determining the injectivity index of the injection well using the relationship further comprises equating the slope of the straight line to the injectivity index.

6. The method of claim 1, wherein determining the relationship between the plurality of injection rates and the plurality of injection bottom hole pressures further comprises determining a correlation coefficient of the relationship.

7. The method of claim 6, wherein determining the injectivity index of the injection well using the relationship further comprises determining the injectivity index of the injection well when the correlation coefficient is greater than a set limit.

8. The method of claim 1, wherein injecting the fluid into the injection well at the plurality of injection rates further comprises changing an injection rate from 130% of an operating injection rate to 70% of the operating injection rate, decreasing at an interval of 10%.

9. The method of claim 8, wherein measuring the injection bottom hole pressure at each injection rate to determine the plurality of injection bottom hole pressures further comprises changing the injection rate and measuring the injection bottom hole pressure at a set frequency.

10. The method of claim 9, wherein determining the injectivity index of the injection well using the relationship further comprises determining the injectivity index of the injection well for a plurality of cycles of time, each cycle using the set frequency to change the injection rate and measure the injection bottom hole pressure.

11. A system for an injection well having an injection wellhead, the system comprising:

a measurement device installed on the injection wellhead, wherein the measurement device is configured to measure a pressure of the injection well at the injection wellhead; and a non-transitory computer readable medium coupled to the measurement device, the non-transitory computer readable medium storing instructions comprising functionality for:

injecting a fluid into the injection well at a plurality of injection rates;

measuring an injection bottom hole pressure at each injection rate to determine a plurality of injection bottom hole pressures, wherein the injection bottom hole pressure at each injection rate is measured using a density of a fluid in the injection well, a depth of the injection well, a pressure loss due to friction, and the pressure of the injection well at the injection wellhead at each injection rate;

determining a relationship between the plurality of injection rates and the plurality of injection bottom hole pressures; and determining an injectivity index of the injection well using the relationship.

12. The system of claim 11, wherein the measurement device further comprises a flow rate measurement device and a pressure measurement device.

13. The system of claim 11, further comprising a storage tank connected to the injection well by a pipeline.

14. The system of claim 11, wherein determining the relationship between the plurality of injection rates and the plurality of injection bottom hole pressures further comprises determining an equation of a straight line having a slope.

15. The system of claim 14, wherein determining the injectivity index of the injection well using the relationship further comprises equating the slope of the straight line to the injectivity index.

16. The system of claim 11, wherein determining the relationship between the plurality of injection rates and the plurality of injection bottom hole pressures further comprises determining a correlation coefficient of the relationship.

17. The system of claim 16, wherein determining the injectivity index of the injection well using the relationship further comprises determining the injectivity index of the injection well when the correlation coefficient is greater than a set limit.

18. The system of claim 11, wherein injecting the fluid into the injection well at the plurality of injection rates further comprises changing an injection rate from 130% of an operating injection rate to 70% of the operating injection rate, decreasing at an interval of 10%.

19. The system of claim 18, wherein measuring the injection bottom hole pressure at each injection rate to determine the plurality of injection bottom hole pressures further comprises changing the injection rate and measuring the injection bottom hole pressure at a set frequency.

20. The system of claim 19, wherein determining the injectivity index of the injection well using the relationship further comprises determining the injectivity index of the injection well for a plurality of cycles of time, each cycle using the set frequency to change the injection rate and measure the injection bottom hole pressure.

* * * * *